US007273412B1

(12) United States Patent
Sun et al.

(10) Patent No.: US 7,273,412 B1
(45) Date of Patent: Sep. 25, 2007

(54) ABRASIVE WHEEL WITH IMPROVED COMPOSING STRUCTURE

(75) Inventors: Yung-yung Sun, Dali (TW); Chuan-ching Cheng, Taichung (TW)

(73) Assignee: Storm Pneumtic Tool Co., Ltd., Taichung County (TW)

( * ) Notice: Subject to any disclaimer, the term of this patent is extended or adjusted under 35 U.S.C. 154(b) by 0 days.

(21) Appl. No.: 11/541,691

(22) Filed: Oct. 3, 2006

(51) Int. Cl.
*B24D 17/00* (2006.01)

(52) U.S. Cl. ..... 451/508; 451/490; 451/526; 451/527

(58) Field of Classification Search ..... 451/490, 451/508, 526, 527
See application file for complete search history.

(56) References Cited

U.S. PATENT DOCUMENTS 3,212,819 A * 10/1965 Churchill ..... 300/21
4,258,509 A * 3/1981 Wray et al. ..... 451/466
4,504,999 A * 3/1985 Pedrotte ..... 15/230.1
5,924,208 A * 7/1999 Saeki ..... 30/388

* cited by examiner

*Primary Examiner*—Joseph J. Hail, III
*Assistant Examiner*—Shantese McDonald
(74) *Attorney, Agent, or Firm*—Rosenberg, Klein & Lee

(57) ABSTRACT

An abrasive wheel with improved structure comprises: an abrasive component, an adapting ring received by the combining hole in the central region of the abrasive component, two covers which are posited about both mounting surfaces respectively, wherein each cover at the surface thereof facing to the corresponding mounting surface has a pressing segment and a blocking segment, wherein each pressing segment comprises a plurality of teeth so that after the disclosed abrasive wheel is assembled, the blocking segment leans against the inner wall of the combining hole and the teeth of the pressing segment lean against the corresponding mounting surface, and further, a plurality of raised columns provided at the surface of each cover facing to the corresponding mounting surface and each opening defined by each two adjacent raised columns which is complementary to the shape of the raised columns so that after the disclosed abrasive wheel is assembled, the raised columns of either the cover can be engaged by the openings of the other cover.

3 Claims, 3 Drawing Sheets

ABRASIVE WHEEL WITH IMPROVED COMPOSING STRUCTURE

BACKGROUND OF THE INVENTION

1. Technical Field

The present invention relates to abrasive wheels and, more particularly, to an abrasive wheel with improved composing structure.

2. Description of Related Art

FIG. 3 shows an exploded view of a conventional abrasive wheel which comprises an abrasive component 7, a reinforcement 8, and two covers 9, wherein the abrasive component 7 includes a combining hole 71 in the central region thereof for accommodating the reinforcement 8; the combining hole 71 is provided with a plurality of retaining parts 72 on the peripheral wall thereof; and the two covers 9 contain a plurality of combining tongues 91 for matching plural intervals 73 between each two retaining parts 72 of the combining hole 71 to attach the two covers 9 to the combining hole 71 at both sides thereof respectively; whereby when an abrasive machine drives one of the two covers 9 to rotate, the combining tongues 91 thereof in turn give an impetus to the retaining parts 72 and the abrasive component 7 is therefore pushed to rotate.

However, the structure of said covers 9 is complicated and requires a correspondingly complicated mold that is relatively difficult to be devised to produce the covers 9. Furthermore, it is essential to arrange the reinforcement 8 in the combining hole 71 to reinforce the component 7 for preventing the abrasive component 7 from unduly deforming under the operating force during a user's operation.

Nevertheless, the necessity of the reinforcement 8 can significantly raise the manufacturing costs; also it requires additional difficulty and steps of fabrication. Hence, a need exists for an improvement in the structure of abrasive wheels.

Further, since it is the combining tongues 91 of the covers 9 pushing the retaining parts 72 that rotate the abrasive component 7, stress concentration may detrimentally arise at the contacting areas of the retaining parts 72 and combining tongues 91. After lasting operation, said stress concentration may incur deformation of the retaining parts 72, and as a consequence, the matching relationship between the retaining parts 72 and combining tongues 91 may deteriorate which finally causes breakage of the combining tongues 91.

SUMMARY OF THE INVENTION

The present invention has been accomplished under the circumstances in view. It is the main object of the present invention to provide an abrasive wheel with improved composing structure that is easy to be fabricated and retrenches manufacturing costs by simplifying the components as well as structure thereof.

To achieve these and other objects of the present invention, the abrasive wheel comprises:

an abrasive component, which has a combining hole and an abrasive segment circling the outer periphery of said combining hole;

an adapting ring received by the combining hole of the abrasive component that has an inner wall circling the combining hole and two mounting surfaces at the both sides thereof respectively;

two covers which are posited about the both mounting surfaces respectively, wherein each cover at the surface thereof facing to the corresponding mounting surface has a pressing segment and a blocking segment, wherein each pressing segment circles the outer periphery of said blocking segment and comprises a plurality of teeth so that after the disclosed abrasive wheel is assembled, each of the blocking segments lean against the inner wall of the combining hole and the teeth of each pressing segment lean against the corresponding mounting surface; and a plurality of raised columns provided at the surface of each cover facing to the corresponding mounting surface and each opening defined by each two adjacent raised columns which is complementary to the shape of the raised columns so that after the disclosed abrasive wheel is assembled, the raised columns of either said cover can be engaged by the openings of the other cover.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
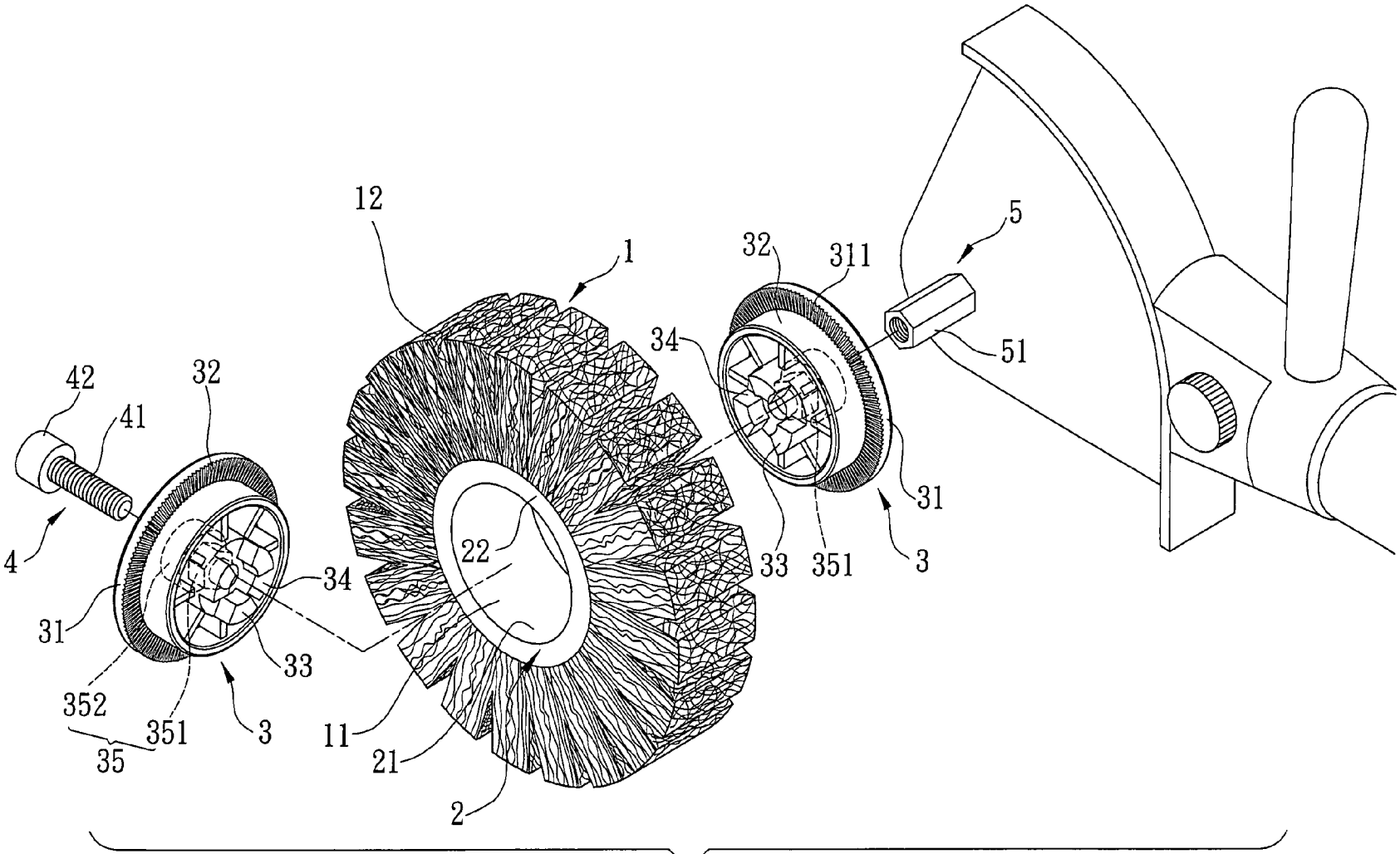
FIG. 1 is an exploded view of the abrasive wheel according to the present invention.
Figure 2:
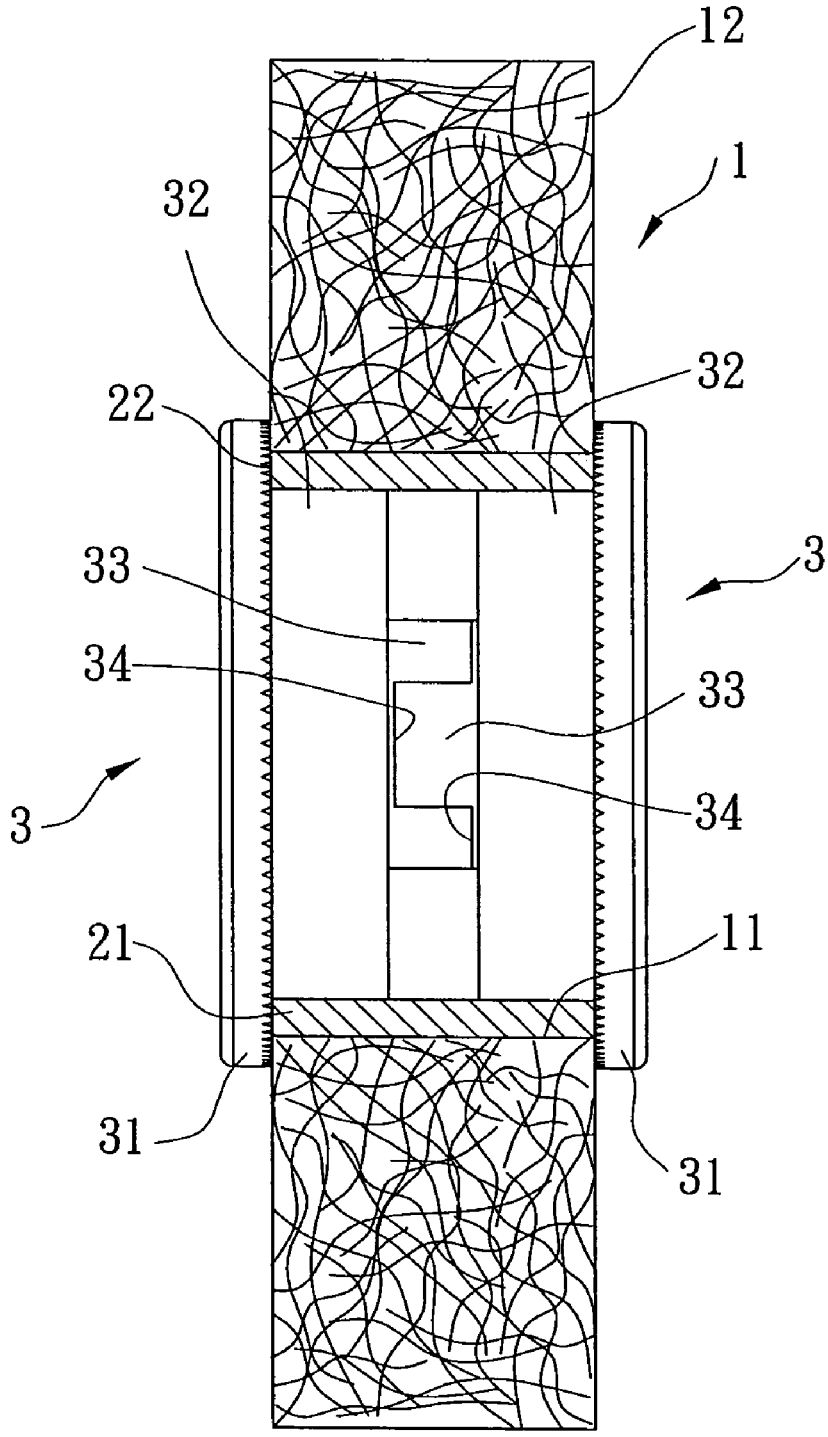
FIG. 2 is a schematic drawing showing the structure of the abrasive wheel according to the present invention.
Figure 3:
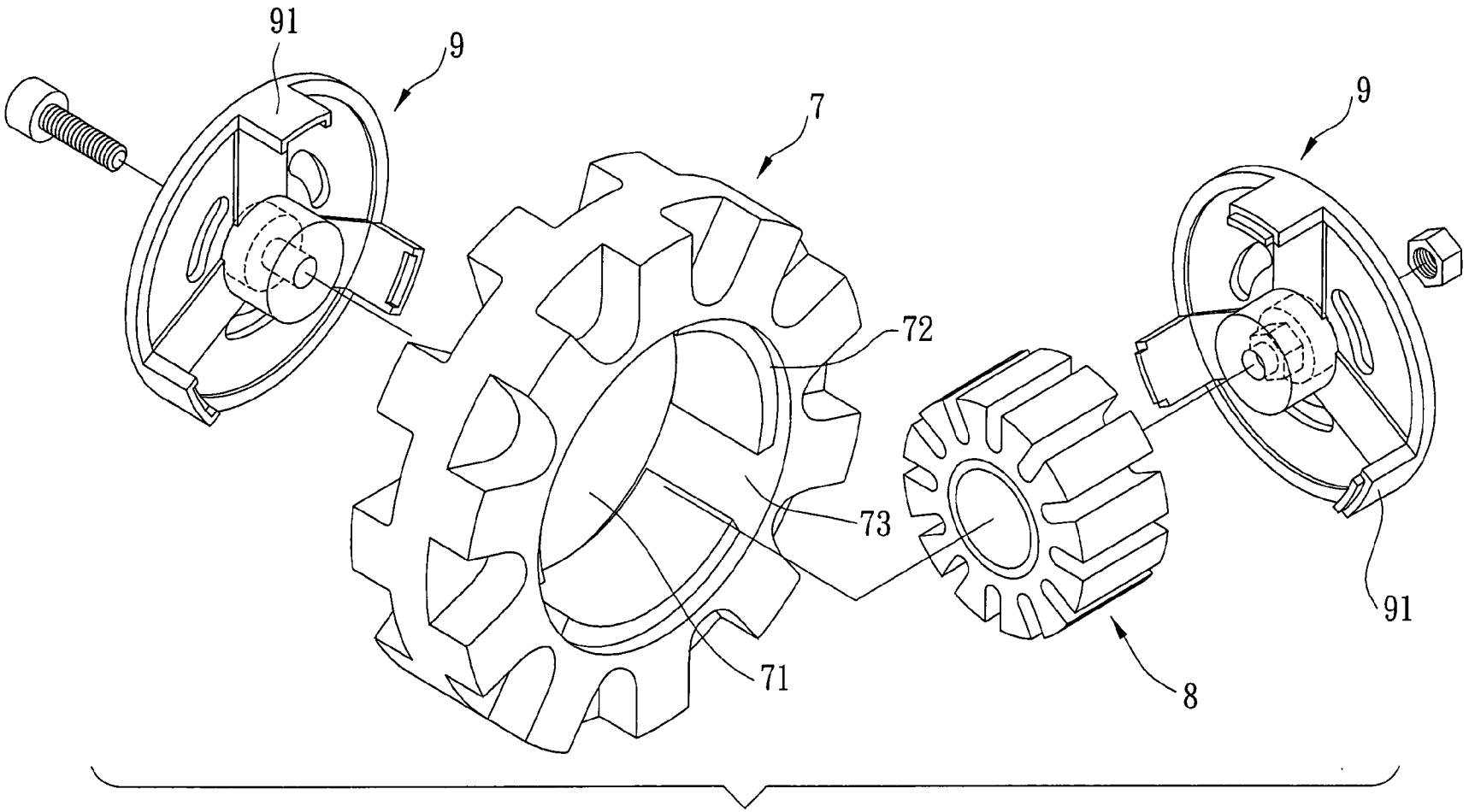
FIG. 3 PRIOR ART
FIG. 3 is an exploded view of a conventional abrasive wheel.

Please refer to FIGS. 1 to 2 for a preferred embodiment of the present invention. It is to be understood that the recited embodiment is for the purpose of illustration and not intended to limit the present invention with the discussed structure.

According to this embodiment of the present invention, the abrasive component comprises an abrasive component 1, which has a combining hole 11 and an abrasive segment 12 circling the outer periphery of said combining hole 11;

an adapting ring 2 received by the combining hole 11 of the abrasive component 1 that has an inner wall 21 circling the combining hole 11 and two mounting surfaces 22 at the both sides thereof respectively;

two covers 3 which are posited about the both mounting surfaces 22 of the adapting ring 2 respectively, wherein each cover 3 at the surface thereof facing to the corresponding mounting surface 22 has a pressing segment 31 and a blocking segment 32, wherein each pressing segment 31 circles the outer periphery of said blocking segment 32 and comprises a plurality of teeth 311 so that after the disclosed abrasive wheel is assembled, the teeth 311 of each said pressing segment 31 lean against the corresponding mounting surface 22, wherein according to this particular embodiment, the teeth 311 of each said pressing segment 31 are centripetally arranged against the center of each cover 3 with space between each two adjacent teeth 311; and a plurality of raised columns 33 provided at the surface of each cover 3 facing to the corresponding mounting surface 22 and each opening 34 defined by each two adjacent raised columns 33 which is complementary to the shape of the raised columns 33 so that after the disclosed abrasive wheel is assembled, the raised columns 33 of either said cover 3 can be engaged by the openings 34 of the other cover 3.

Since each said blocking segment 32 of each said cover 3 adequately supports the adapting ring 2 at the inner wall 22 thereof, it facilitates preventing the adapting ring 2 from deformation so that a reinforcement implemented in the prior art can be dispensed with. Thus, when using the disclosed subject matter, the components of the abrasive wheel can be advantageously simplified and the manufacturing costs thereof can be in turn reduced.

Besides, a through hole 35 is provided at the center of each said cover 3 that comprises a reduced diameter section 351 and a magnified diameter section 352. Further combined to the two covers 3 are a first locking member 4 having a treaded portion 41 and a magnified head portion 42 whose diameter is greater that that of the reduced diameter section 351, and a second locking member 5 having a plurality of prismatic surfaces 51 at the outer periphery thereof. To fabricate the disclosed abrasive wheel, the portion 41 of the first locking member 4 is pierced through one of said covers 3 to screw into the second locking member 5 which is fixed in the reduced diameter section 351 of the other cover 3 whereby the two covers 3 are oppositely closed toward each other. In fact, the second locking member 5 is further fastened to an existing abrasive machine.

After the disclosed abrasive wheel is composed, the teeth 311 of the pressing segment 31 press against the corresponding mounting surface 22 of the adapting ring 2 wherein the hardness of the pressing segments 31 of the covers 3 is greater than that of the adapting ring 2, so that when either the cover 3 is rotated, the abrasive component 1 that combined with the adapting ring 2 can in turn be driven to rotate synchronously.

Moreover, as the teeth 311 of the pressing segment 31 press against the corresponding mounting surface 22 of the adapting ring 2, the covers 3 and the adapting ring 2 can be retained mutually without the worry of becoming unfastened, and in the meantime, attrition of the pressing segment 31 can be minimized to ensure the service life thereof.

Although a particular embodiment of the invention has been described in detail for purposes of illustration, it will be understood by one ordinarily skilled in the art that numerous variations will be possible to the disclosed embodiments without going outside the scope of the invention as disclosed in the claims.

What is claimed is:

1. An abrasive wheel with improved composing structure, which comprises:

an abrasive component having a combining hole and an abrasive segment circling an outer periphery of said combining hole;

an adapting ring received in the combining hole of the abrasive component, said adapting ring having an inner wall circling the combining hole and two mounting surfaces respectively disposed on opposing sides thereof;

two covers respectively posited adjacent each mounting surface of the adapting ring, wherein each cover has a surface facing a corresponding mounting surface of the adapting ring, each cover has a pressing segment and a blocking segment, wherein said pressing segment circles an outer periphery of said blocking segment and includes a plurality of teeth, the blocking segment presses on the inner wall of the adapting ring and the teeth of the pressing segment press on the corresponding mounting surface; and a plurality of raised columns extending from the surface of each cover facing the corresponding mounting surface of the adapting ring in spaced angular relationship, a plurality of openings being respectively disposed between said plurality of raised columns, said openings being respectively shaped complementary to a shape of the raised columns, whereby after the abrasive wheel is assembled, the raised columns of each said cover are respectively engaged in the openings of the other cover.

2. The abrasive wheel with improved composing structure as claimed in claim 1, wherein the teeth of said pressing segment are arranged to extend radially from an outer periphery of said blocking segment of each cover with a space being disposed between adjacent teeth.

3. The abrasive wheel with improved composing structure as claimed in claim 1, wherein a through hole is provided at a center of each said cover that comprises a reduced diameter section and an enlarged diameter section; a first locking member having a threaded portion and an enlarged head portion having a diameter larger than that of the reduced diameter section, and a second locking member having a plurality of prismatic surfaces at an outer periphery thereof are respectively combined to the two covers, whereby the threaded portion of the first locking member is inserted through one of said covers to screw into the second locking member which is fixed in the reduced diameter section of the other of said covers to secure the two covers to each other.

* * * * *